US007150364B2

(12) United States Patent
Jablow et al.

(10) Patent No.: US 7,150,364 B2
(45) Date of Patent: Dec. 19, 2006

(54) SHELVING

(75) Inventors: David B. Jablow, Warren, NJ (US); Alan J. Kaufman, Warren, NJ (US); Enrico Spinelli, Stabbia (IT); Michael Miller, Fort Lee, NJ (US); Jack Miller, Englewood Cliffs, NJ (US)

(73) Assignee: Tube Technology, LLC, Newark, NJ (US)

( * ) Notice: Subject to any disclaimer, the term of this patent is extended or adjusted under 35 U.S.C. 154(b) by 215 days.

(21) Appl. No.: 10/744,151

(22) Filed: Dec. 22, 2003
(Under 37 CFR 1.47)

(65) Prior Publication Data

US 2004/0206714 A1 Oct. 21, 2004

Related U.S. Application Data

(63) Continuation-in-part of application No. 10/387,350, filed on Mar. 12, 2003, now abandoned, which is a continuation-in-part of application No. 29/173,600, filed on Dec. 31, 2002, now Pat. No. Des. 487,369.

(60) Provisional application No. 60/437,064, filed on Dec. 30, 2002.

(51) Int. Cl.
*A47F 5/08* (2006.01)

(52) U.S. Cl. ..... 211/153; 211/87.01; 211/90.02; 211/175

(58) Field of Classification Search ..... 211/153, 211/88.02, 43, 90.01, 175, 90.02, 201, 204, 211/206, 149, 105.3, 105.2, 186, 105.1, 86.01, 211/87.01; 108/109, 193, 137, 102; 248/220.22, 248/235, 241, 250, 274.1
See application file for complete search history.

(56) References Cited

U.S. PATENT DOCUMENTS

| | | | | | |
|---|---|---|---|---|---|
| D105,885 | S | | 8/1937 | McDonald | |
| 2,276,141 | A | * | 3/1942 | Atkinson | 211/37 |
| 2,640,599 | A | * | 6/1953 | Alexander | 108/29 |
| 2,885,090 | A | | 5/1959 | Forman et al. | |
| 3,433,549 | A | * | 3/1969 | Brorson et al. | 312/245 |
| D214,923 | S | | 8/1969 | Schier et al. | |
| 3,563,182 | A | | 2/1971 | MacFarlane et al. | |
| 3,888,353 | A | * | 6/1975 | Leifheit | 211/37 |
| 4,111,309 | A | * | 9/1978 | Henry | 211/104 |
| 4,285,484 | A | * | 8/1981 | Follows | 248/235 |
| D282,995 | S | | 3/1986 | Beverly | |
| 4,603,781 | A | | 8/1986 | Ryan, Jr. | |
| 4,713,949 | A | * | 12/1987 | Wilcox | 68/235 R |
| 4,936,467 | A | | 6/1990 | Bobeczko | |
| 5,228,581 | A | | 7/1993 | Palladino et al. | |
| 5,253,837 | A | * | 10/1993 | Loux | 248/250 |

(Continued)

*Primary Examiner*—Jennifer E. Novosad
(74) *Attorney, Agent, or Firm*—Warner Norcross & Judd LLP

(57) ABSTRACT

The expandable shelf of the invention is formed of several telescoping tubular assemblies that are supported in parallel to one another between a pair of end plates. The tubular assemblies may be press fit into the end plates. The end plates are mounted to opposed walls. A center bracket is provided to supportably mount between the end plates for embodiments having long or flexible tubes. In another embodiment, one end plate is mounted to a wall and a second end plate is supported on a floor-mounted column. A further embodiment includes support plates that are mounted to wall surfaces and further receive the end plates to support the expandable shelf. An additional embodiment includes a solid surface platform that is adjustable in length to mount onto the expandable shelf.

11 Claims, 10 Drawing Sheets

U.S. PATENT DOCUMENTS

D385,140 S 10/1997 Whitehead et al.
5,992,647 A * 11/1999 Malik ..... 211/34
6,019,331 A * 2/2000 Hoogland et al. ..... 248/250
6,257,425 B1 * 7/2001 Liu ..... 211/90.01
D455,585 S 4/2002 West
D487,369 S * 3/2004 Miller et al. ..... D6/574
6,786,337 B1 * 9/2004 Klein et al. ..... 211/34

* cited by examiner

SHELVING

BACKGROUND OF THE INVENTION

This is a continuation-in-part of U.S. application Ser. No. 10/387,350, filed Mar. 12, 2003, now abandoned which is a continuation-in-part of U.S. Design Application 29/173,600, filed Dec. 31, 2002, now U.S. Pat. No. D,487,369 and which claims benefit of U.S. provisional application 60/437,064, filed Dec. 30, 2002 now abandoned.

The present invention relates to the field of shelving for use in the home and workplace.

Many areas of the home and workplace are dedicated to storing and organizing items. For example, in the home and workplace, closets, cabinets and similar storage spaces are used to store a variety of items, such as clothing, cleaning products, personal care products, kitchen utensils, office supplies, and the like. To improve the organization and capacity of storage spaces, shelving is commonly used.

Conventional shelving is fastened to the interior structure of storage spaces, for example the walls of the closets or cabinets, with screws and/or nails. The shelving is cut to closely fit the dimensions of the confined spaces between closet or cabinet walls. Cutting the shelving components to these dimensions is difficult for many homeowners, or operators of small businesses, who are attempting to install such shelving at a minimal cost (i.e., avoiding paying a contractor for installation).

As one solution to this problem, modular shelving products are offered in home improvement centers. Modular shelving products are precut and sized to fit within standard sized closets or cabinets. In many homes, however, the closets and cabinets are not of standard sizes, and therefore the modular shelving does not fit properly within the storage space without significant modification to its structure. This requires cutting the shelf unit or building out a portion of an adjacent wall.

SUMMARY OF THE INVENTION

The aforementioned problems are overcome by the expandable shelf of the present invention. The expandable shelf includes multiple outer tubes secured to one end plate and multiple inner members secured to another end plate, where the inner members fit within the outer tubes in a telescoping manner.

In one embodiment, a central bracket is provided to support the outer tubes and inner members midway along their length, thus increasing the strength and security of the shelf unit. The central bracket is preferably attachable to a wall surface to maintain horizontal orientation of the shelf unit.

In another embodiment, the end plates may include a potion or member that extends downwardly with respect to a plane defined by the support tubes. One or more telescoping sets of outer tubes and inner members is secured to the downwardly directed portion of the end plates. With the portion extending downwardly, the supported telescoping set forms a hanging rod for clothes. Alternatively or additionally, the extending portion extends upwardly, in which case the telescoping set forms a barrier to prevent objects placed on the support tubes from falling off the expandable shelf.

In yet another embodiment, secondary supporting end plates are provided. These secondary plates interlock with the end plates to support the shelf unit relative to a wall or other structure. Optionally, the secondary supporting end plates define a recess within which the end plates interfit.

The expandable shelf of the present invention fits precisely within a variety of different-dimensioned storage spaces. By extending or retracting the inner support members from the outer support tubes, the dimension of the shelf can be rapidly and easily adjusted to form a shelf configured to snugly fit between opposing walls or structures of a storage space.

With the expandable shelf expanded to the desired configuration, a user fastens the end plates to the wall with conventional fastening means to provide a sturdy and rigid storage shelf. Where secondary support plates optionally are included, the user first fastens these secondary support plates to a wall, and then connects the end plates of the shelf unit to the support plates to install the shelf.

In a further embodiment of the present invention, a solid platform formed of an upper platform and a lower platform that are slidably connected to one another, is provided to be mounted on the expandable shelf of the invention. The solid platform serves to prevent small objects from falling between the telescoping tubes of the invention expandable shelf. The platforms are fitted with means for attachment to the expandable shelf.

In another embodiment of the present invention, a support column is provided to support a first end of the expandable shelf in horizontal position when opposing walls are not available, e.g. if the expandable shelf is used in a room corner. In this embodiment, a second end of the expandable shelf is connected to a wall surface.

In yet another embodiment of the present invention, one or both of the end plates is removably attachable to the telescoping tubes. In this embodiment, the end plates are each mounted to a wall surface and then the telescoping tubes, optionally held in a central plate for alignment, are assembled to the already mounted plates.

In a further additional embodiment, the end plates include apertures and/or recesses. The tubes or members are press-fit into the apertures and/or recesses to provide a sturdy, easy-to-assemble construction.

These and other objects, advantages and features of the invention will be more readily understood and appreciated by reference to the detailed description of the invention and the drawings.

DETAILED DESCRIPTION OF THE INVENTION

Figure 1:
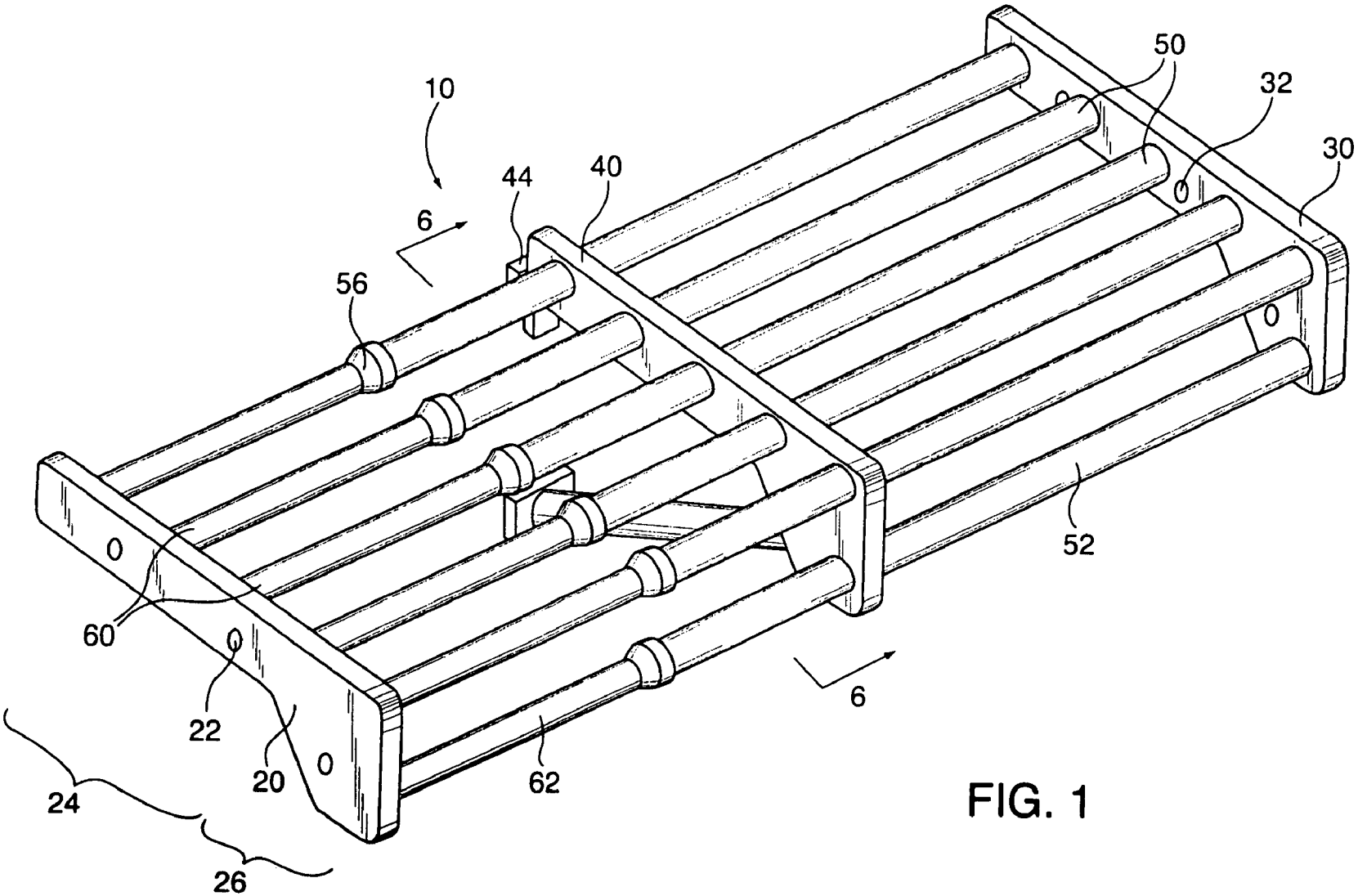
FIG. 1 is a top perspective view of a first embodiment of the expandable shelf of the present invention.

Referring to FIG. 1, a first preferred embodiment of the expandable shelf 10 is illustrated in perspective view. Expandable shelf 10 has a first end plate 20 and a second end plate 30. End plate 20 is formed with a series of mounting holes 22 and end plate 30 is formed with a series of mounting holes 32. Each of the mounting holes 22, 32 is adapted for receiving a fastener for securely holding the respective end plates 20, 30 to a wall surface. A plurality of telescoping assemblies made up of outer tubes 50 and inner members 60 are mounted between end plate 20 and end plate 30. Inner members 60 may be either solid or tubular.

In this first embodiment of the invention, outer tubes 50 and inner tubes 60 are fixedly connected to respective end plates 20, 30. Outer tubes 50 and inner members 60 may each be removably connected to end plates 20, 30 by mounting onto a stud projecting from the surface of respective plate 20, 30 or inserting into a cavity formed thereinto. The engagement of outer tubes 50 and inner members 60 with the receiving studs or cavities is understood to be substantially tight, for example by conical fitting. In one embodiment, the cavities may be substituted with recesses 31, 21 (FIG. 11) defined in and/or secured to the end plates. These recesses may be of smaller dimensions than the tubes or members. Accordingly the tubes or members may be press-fit into and permanently joined with the end plates within the recesses. The end plates and tubes or members may include other features that facilitate press-fit joining thereof as desired.

As shown in FIG. 1, to provide a gradual transition between outer tube 50, being of a relatively larger diameter and inner member 60, being of a relatively smaller diameter, an adapter 56 is provided at the end of each outer tube 50. Alternately, the end of outer tube 50 can be formed into a cone to smoothly diminish to approximately the diameter of inner member 60.

Figure 11:
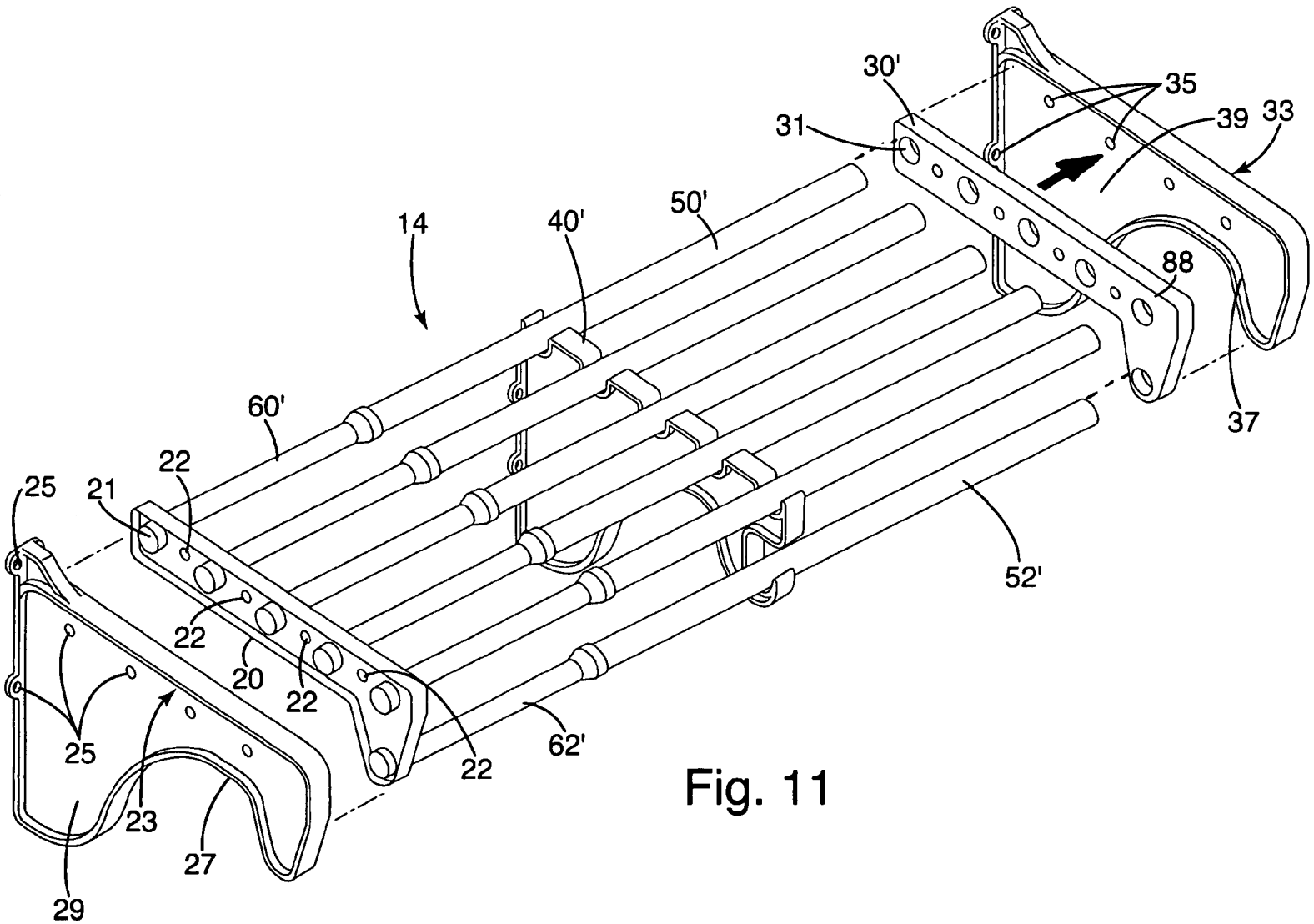
FIG. 11 is an exploded top perspective view of a fifth embodiment of the expandable shelf including secondary supporting end plates.

In one embodiment, a center bracket 40 is provided to slidingly mount on outer tubes 50 so as to be positionable at a desired location along the length of the assembled outer tubes 50 and inner members 60 in accordance with the overall length to which expandable shelf 10 is expanded. Center bracket can be formed with a plurality of apertures through which pass outer tubes 50 or with a plurality of upwardly open slots in which to support outer tubes 50. For situations where the adjustable shelf 10 is substantially long or where the adjustable shelf 10 is expected to support a heavy load, plural center brackets 40 are supplied. An optional alternative to the center bracket 40' of FIG. 1 is shown in FIG. 11. There, the center bracket 40' includes multiple recesses 41 along the upper surface of the bracket. These recesses are configured to accept the tubes 50', 52' or rods 60', 62', as desired. Accordingly the recesses may be shaped like the tubes or rods. Optionally, the recesses include a lip at their uppermost portion. This lip may act to further secure the components within the recess.

As is shown in FIG. 1, each of end plates 20, 30 and center plate 40 is formed with a linear body portion 24 and a head portion 26 that extends generally perpendicularly to body portion 24. Head portion 26 is intended to be installed distal from a rear wall to which expandable shelf 10 is mounted. A further telescoping assembly of outer tube 52 and inner tube 62 is mounted between end plates 20, 30 in a location out of a plane defined by outer tubes 50 and inner members 60. The expandable shelf 10 can be mounted as illustrated, wherein outer tube 52 and inner member 62 provide a rod for hanging clothing on conventional coat hangers with open hook tops. Alternately, expandable shelf 10 can be mounted upside-down with respect to the illustration of FIG. 1, wherein outer tube 52 and inner member 62 provide a barrier to prevent objects stored on expandable shelf 10 from falling off. When mounted upside-down, the distal outer tube 50 and inner member 60 assembly can support hanging clothing. Optionally, the expandable shelf may include both a hanging rod and a barrier (not shown) by duplicating the hanging rod above the tubes 50 and members 60. Further optionally, the hanging rod and/or barrier may be absent from the shelf altogether. Accordingly, the head portion 26 is also absent from the shelf.

Figure 2:
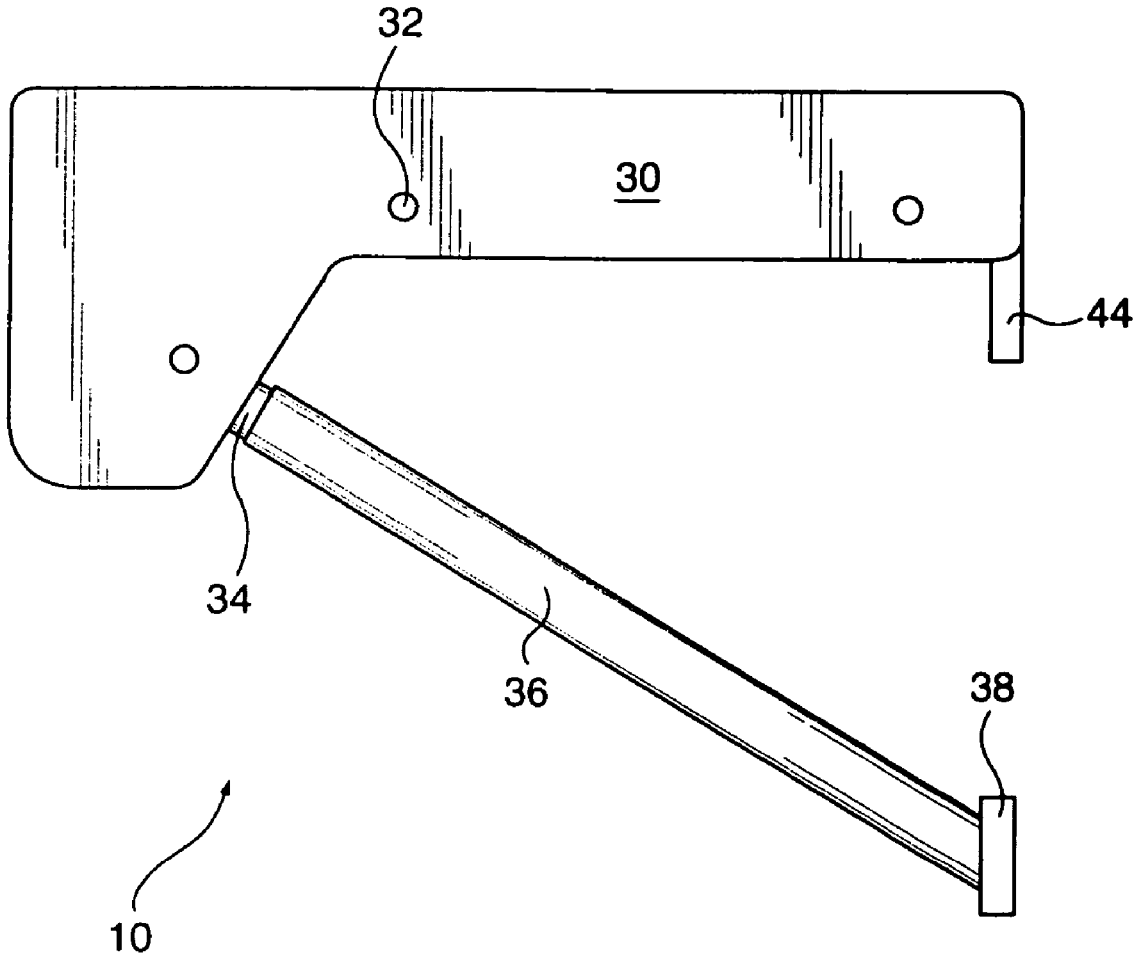
FIG. 2 is a side elevation view thereof.
Figure 3:
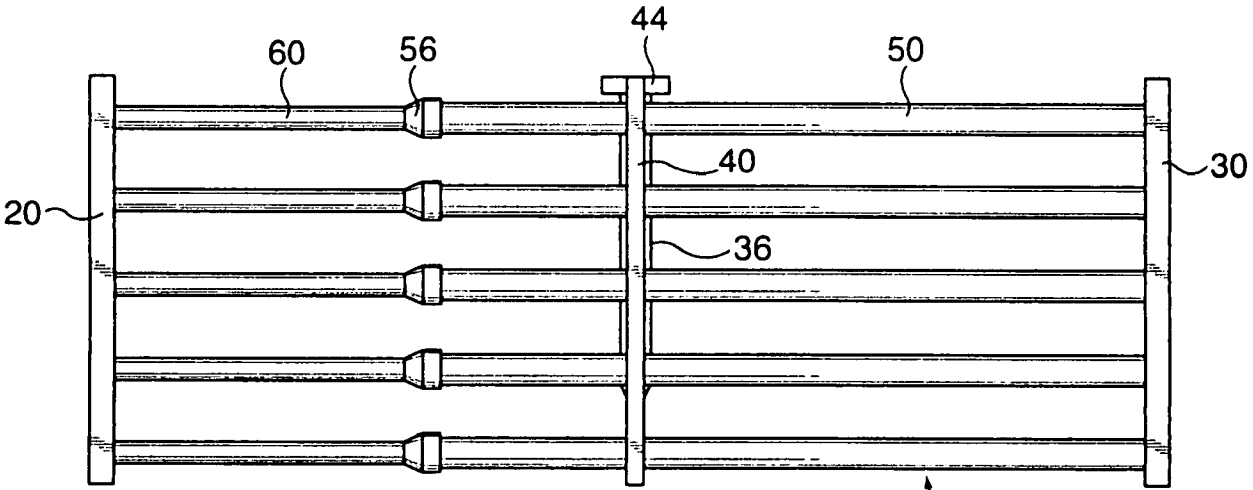
FIG. 3 is a top plan view thereof.

Expandable shelf 10 is illustrated in side elevation view in FIG. 2, with end plate 30 visible and center bracket 40 obscured. As is seen in FIGS. 1 and 2, center bracket 40 is formed with a hanger 44 which is readily attachable to a wall upon mounting expandable shelf 10. A connector 34 is fixed to center bracket 40 so as to connect support brace 36, terminating in a wall-connective support plate 38. By fixedly connecting support plate 38 and hanger 44 to a wall against which expandable shelf 10 is mounted, the central portion of expandable shelf 10 is maintained at the level of the end plates 20 (see FIG. 1) and 30. FIG. 3 shows a top plan view of expandable shelf 10 with the features described above. FIG. 11 illustrates an alternative center bracket 40' which operates similarly to that shown in FIG. 3. However, each rod 50', 52' is independently supported by bracket 40'.

Figure 6:
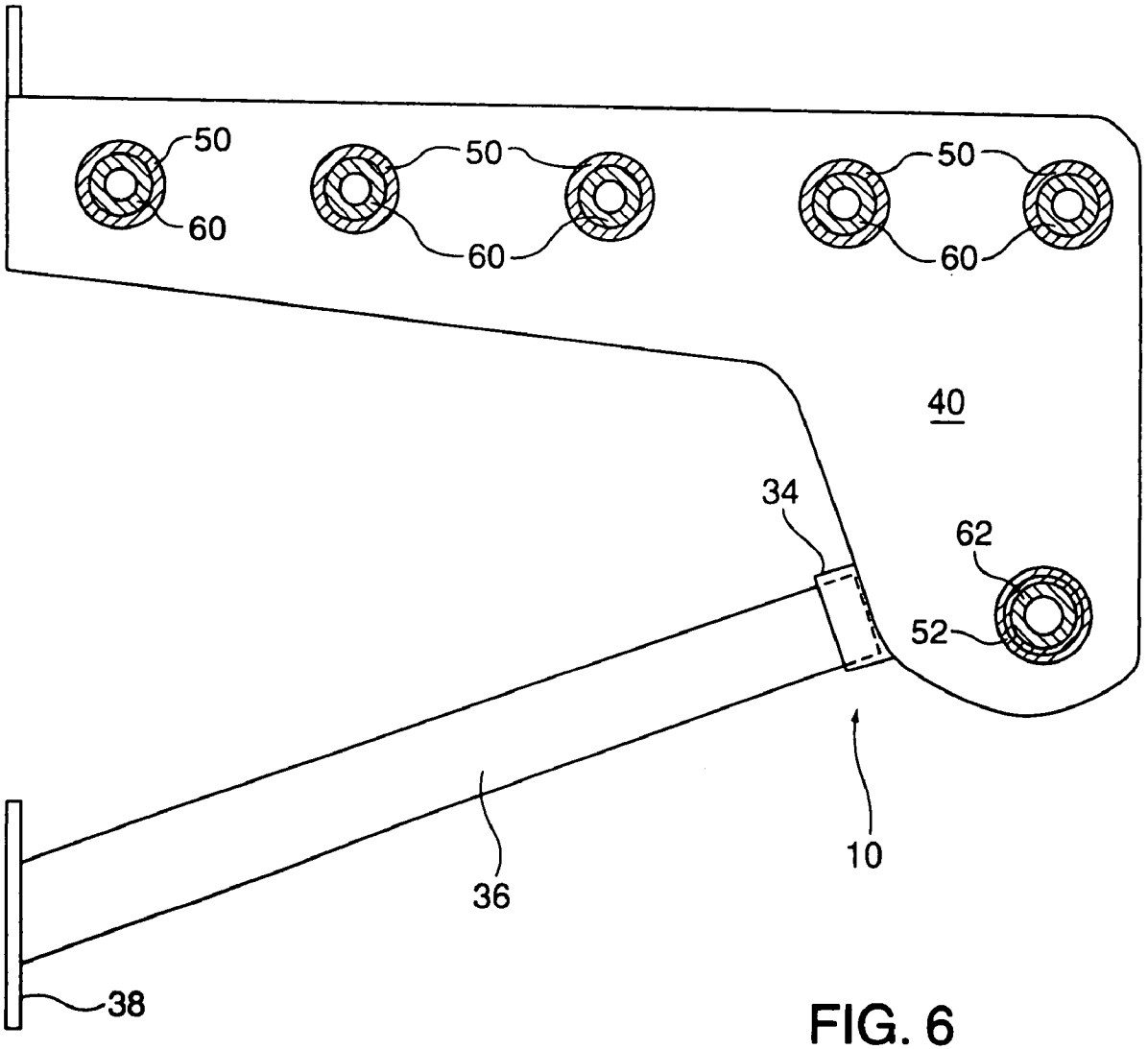
FIG. 6 is a sectional view taken along line 6—6 of FIG. 1.

Referring now to FIG. 6, a cross sectional view of expandable shelf 10 is illustrated as taken in the direction of line 6—6 of FIG. 1. FIG. 6 illustrates the sliding relation of inner tubes 60 and 62 within respective outer tubes 50 and 52. Tube assemblies 50, 60 will preferably be positioned at substantially equal spacing from one another along a line that is parallel to the top of side plates 20, 30 and center bracket 40. Tube assembly 52, 62 is preferably positioned substantially below the outermost assembly of tubes 50, 60. Tubes 50, 52, and members 60, 62 are made of thin wall metallic tubing and preferably painted or resin coated for appearance and handling. If a resin coating s applied, such coating can be contoured, e.g. ribbed, for increase in friction with items placed thereon. Tubes 50, 52, 60 and 62 are illustrated as round, but any other cross sectional shapes, e.g. square, rectangular, triangular, octagonal, oval or hexagonal, are acceptable.

Figure 4:
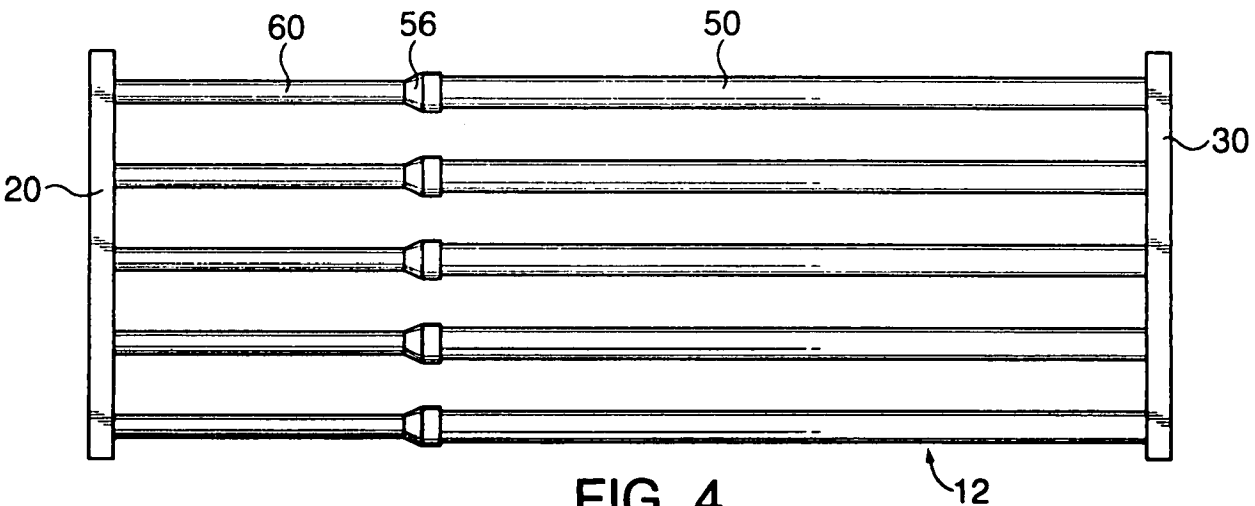
FIG. 4 is a top plan view of a second embodiment of the expandable shelf of the present invention.
Figure 5:
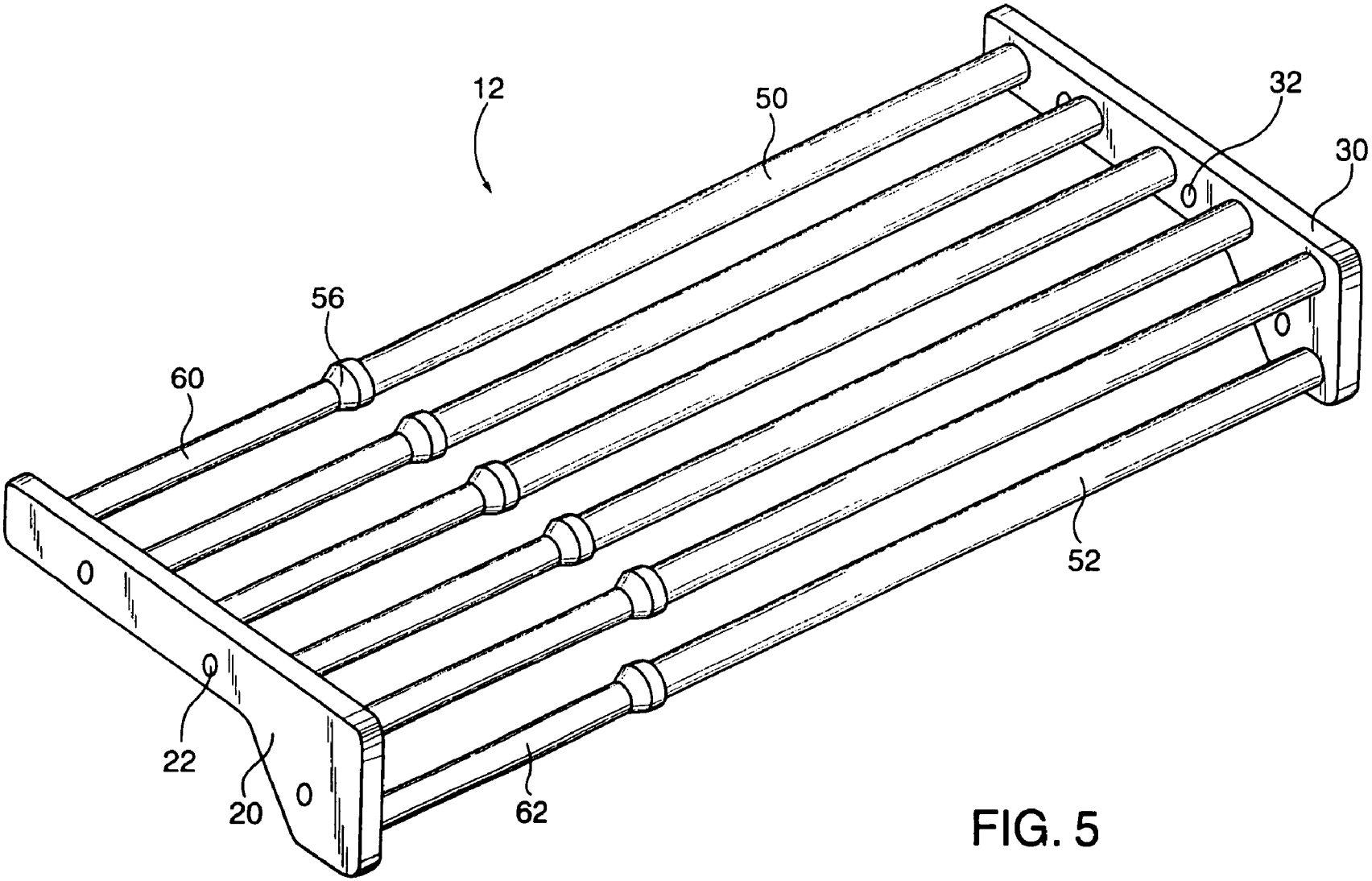
FIG. 5 is a top perspective view thereof.

FIGS. 4 and 5 show respective top elevation and perspective views of a second embodiment of the invention. The expandable shelf 12 shown in FIGS. 4 and 5 is similar to the first embodiment of the invention, with the exception that no central bracket is provided. If no center bracket is used, either the length of expandable shelf 12 is to be restricted or the stiffness of outer tube and inner member assemblies 50/60 is increased to minimize bending.

Figure 7:
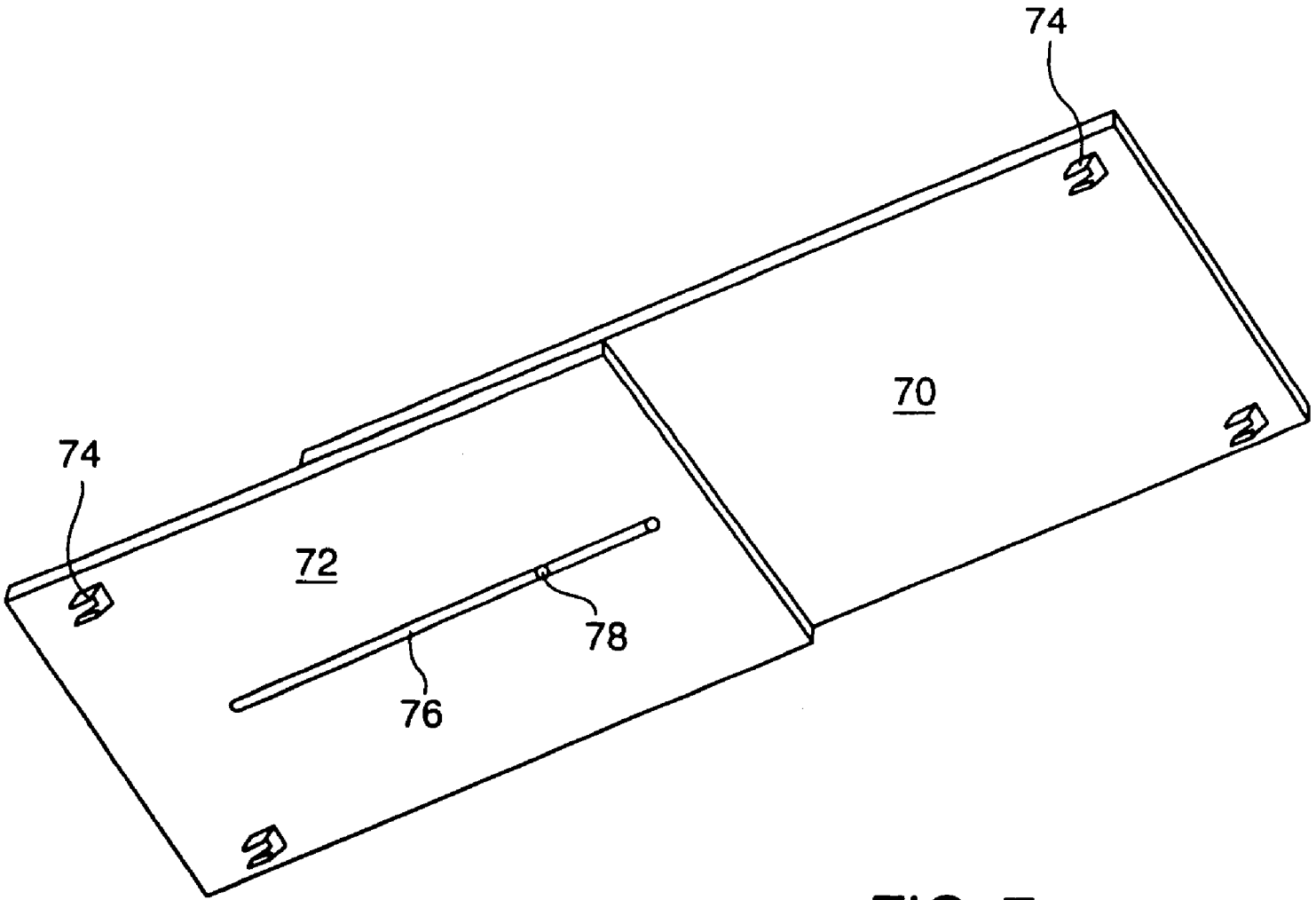
FIG. 7 is a bottom perspective view of an expandable platform optionally used with the expandable shelf of the present invention.
Figure 8:
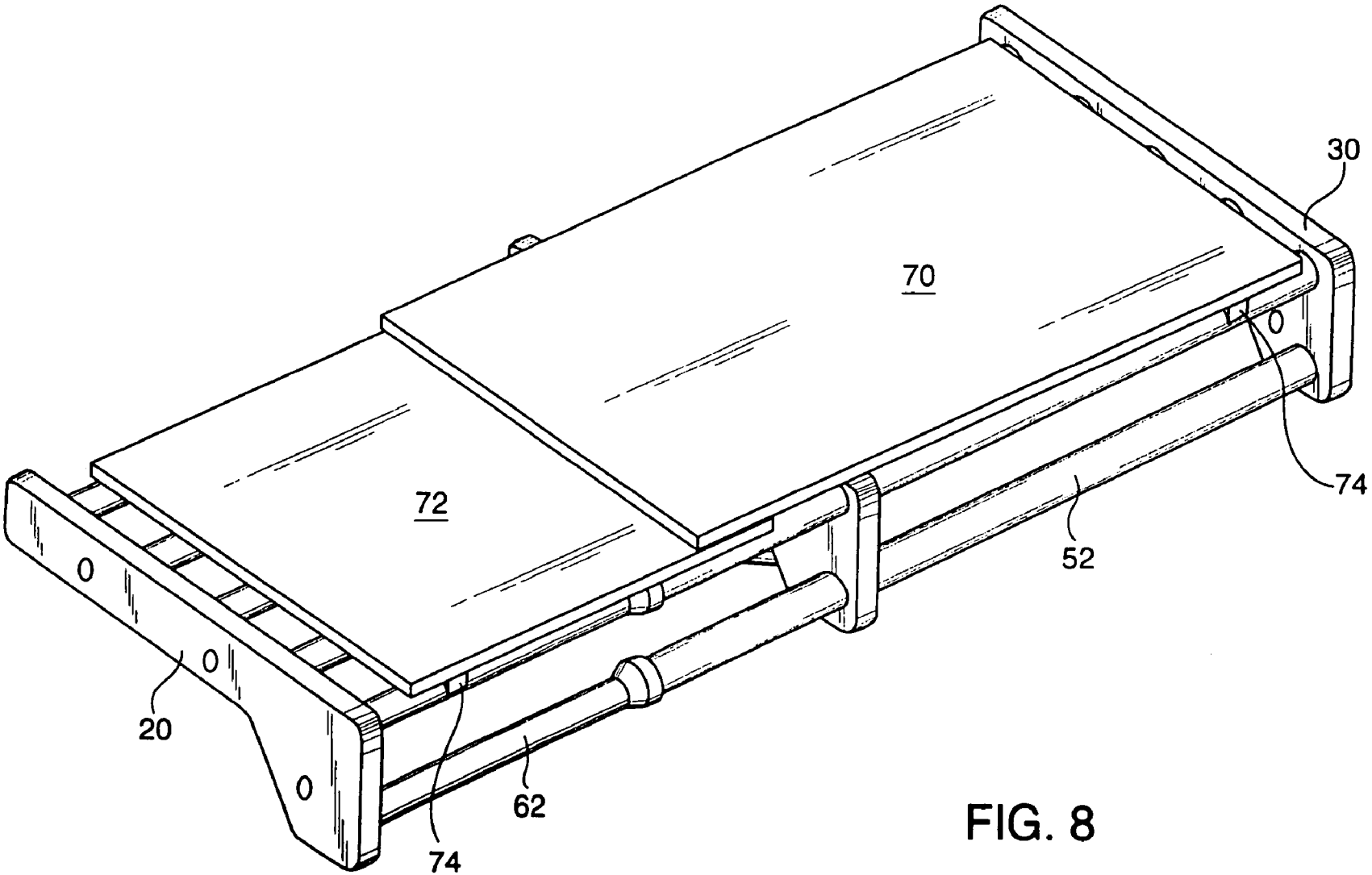
FIG. 8 is a top perspective view of the expandable platform of FIG. 7 mounted to the expandable shelf of FIG. 1.

The present invention further recognizes that for certain applications, for example when small items are to be stored on the shelf, a solid shelf is superior to an open shelf formed of parallel tubes. FIG. 7 illustrates a telescoping platform that is adaptable to be sized to substantially cover expandable shelf 10, as depicted in FIG. 8. Upper platform 70 is slidingly assembled to lower platform 72 by inserting a pair of fasteners 78 through a linear slot 76. Fasteners 78 are formed with a thin shank and a large head to retain platforms 70, 72 in sliding contact with one another. In an alternate embodiment of the invention, the telescoping platform shown in FIG. 7 may be made of a first tubular platform into which a second platform is slidingly inserted. Two clamps 74 are mounted to a lower surface of platform 70 and two additional clamps 74 are mounted to a lower surface of platform 72 so that the four clamps are positioned approximately at corners of the assembled platforms 70, 72. When platforms 70, 72 are mounted to shelf 10, clamps 74 snugly engage respective outer and inner tubes 50, 60. Clamps 74 are preferably of the spring clamp type, as is known.

Figure 9:
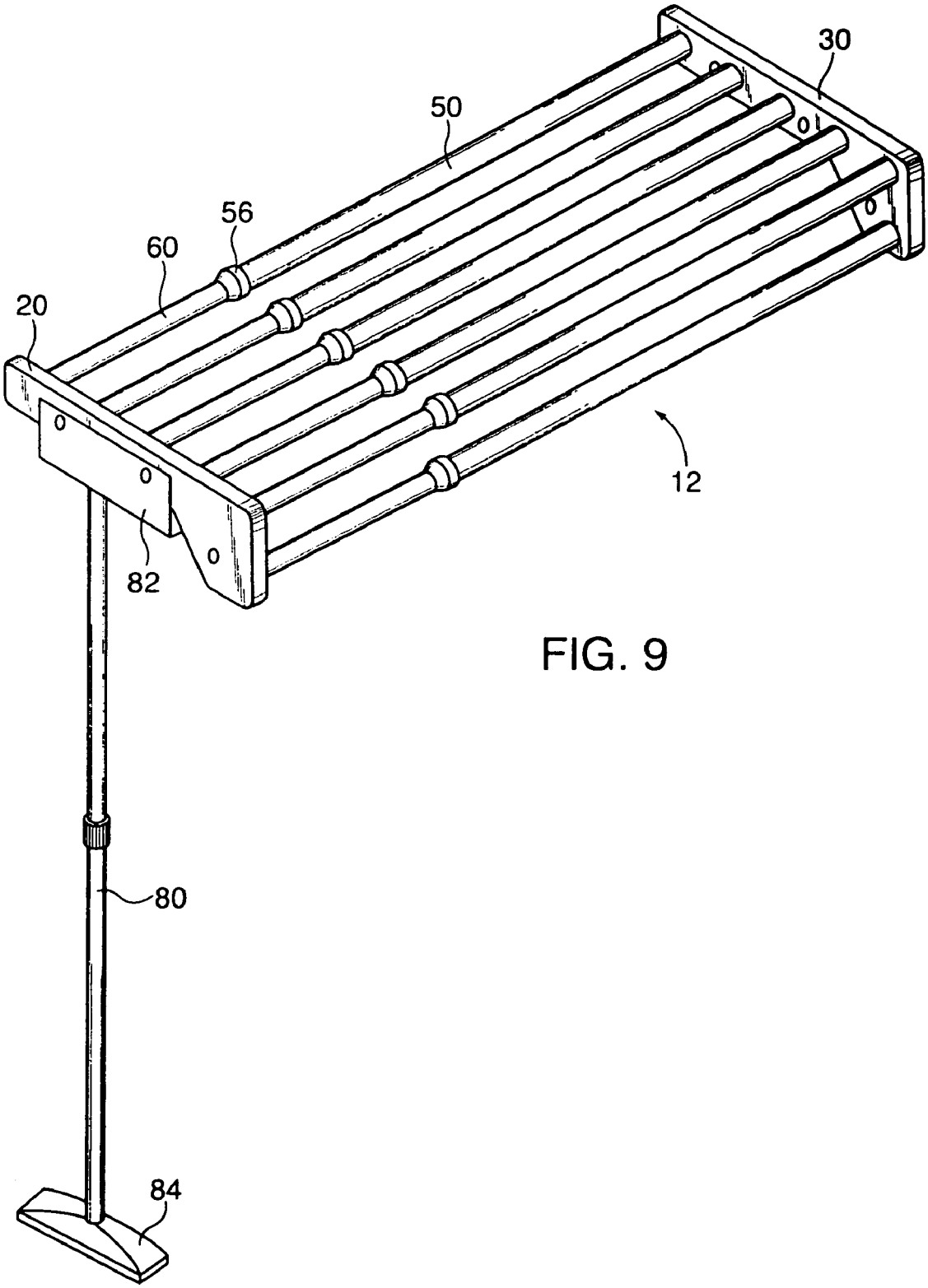
FIG. 9 is a top perspective view of a third embodiment of the expandable shelf where one end thereof is supported by a column.

The invention further recognizes that while shelves are commonly used in closets or cabinets where two opposed walls are available for mounting, this is not always the case. A further embodiment of the expandable shelf of the invention is illustrated in FIG. 9. Expandable shelf 12 is substantially similar to the shelf described in relation to FIGS. 4 and 5. In the situation where end plate 30 is positioned against and mounted to a wall surface, but end plate 20 cannot be mounted to a wall surface, end plate 20 is seen as being supported on bracket 82 that is supported on column 80 that is supported on base 84. As illustrated, bracket 82 is provided with formed holes for attachment to end plate 20. Column 80 is preferably formed of an outer tube and an inner tube with a locking ring therebetween for adjusting the length of column 80. Optionally, base 84 is to be anchored to the floor. In a further variation, shelf 12 may be mounted in an opposite orientation, where end plate 20 is mounted to a wall and end plate 30 is supported on a column 80. In an additional variation, column 80 extends upwardly beyond expandable shelf 12 to engage a ceiling (not shown), thus increasing the rigidity of the installation.

Figure 10:
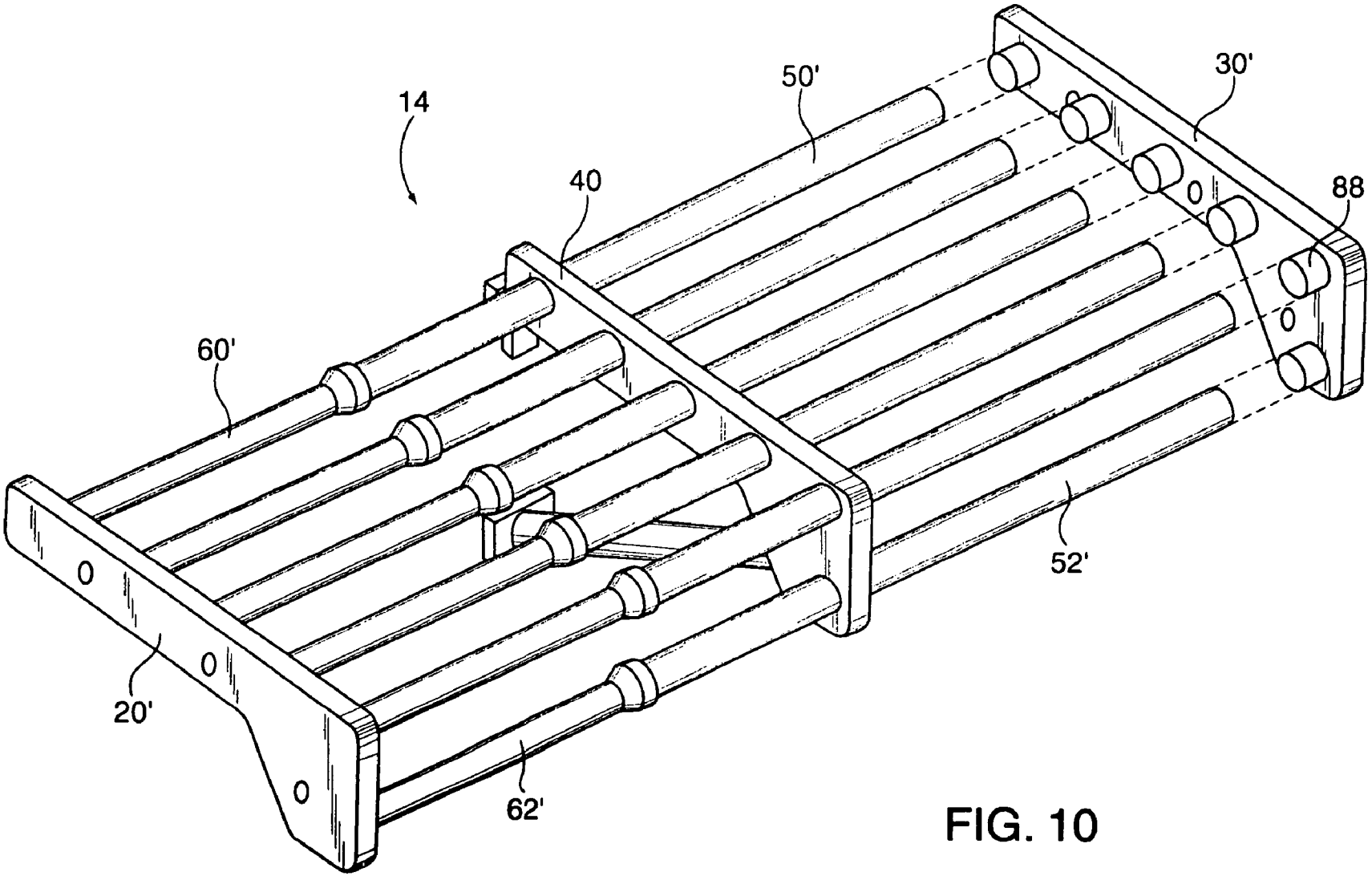
FIG. 10 is an exploded top perspective view of a fourth embodiment of the expandable shelf where one end is separated from the expandable shelf for mounting to a wall surface.

In a still further embodiment of the expandable shelf 14 of the invention, seen in FIG. 10, end plate 30' is formed to be removable from each of outer tubes 50'. The means of attachment comprises a number of receptors 88, such as either studs extending from the side surface of end plate 30' or as cavities or recesses (FIG. 11) formed into the side surface of end plate 30', allowing tubes 50' to either slide over or slide into the mating receiving formation. Similar studs or cavities are provided on end plate 20'. In this way, a user mounts each end plates 20', 30' to opposed wall surfaces without having to hold the entire shelf unit up. When the end plates 20', 30' are hung, each of tubes 50', 52' and members 60' 62' is assembled to respective receptors 88 and center bracket 40 is positioned near to the center of expandable shelf 14 for mounting to the wall.

In a further variation of the invention, one end plate, e.g. 30' is separate from the balance of expandable shelf 12 and the other end plate, e.g. 20' is permanently attached. The user thus installs the unattached end plate 30' to the side wall, engages outer tubes 50' to the receptors 88, and supports fixedly connected end plate 20' while mounting it to the opposite wall surface. In a further embodiment of the invention, fixedly connected end plate 20' is supported by a column 80, as shown in FIG. 9. Optionally, another expandable column (not shown) identical to column 80 may support opposite end plate 30 so that the resulting shelf and columns forms a portable coat rack with expandable shelving. Moreover, this coat rack may be further modified to include one or more additional shelves to add further rigidity to the rack. In an additional variation, both end plates 20' and 30' are separately provided and individually mounted to respective first and second walls as described above.

FIG. 11 shows another embodiment of the expandable shelf 14, which includes a unique center bracket 40' (described above) and supporting end plates 23 and 33, also referred to as secondary supporting end plates. The supporting end plates may further include panels 29 and 39. Around the periphery of the panels 29 and 39 is disposed a flange 27 and 37 respectively. This flange may extend away from the panels 29 and 39 on one or both sides of the panels. For example, where the flanges 27 and 37 extend from only one side of the panels 29 and 39, respectively, the resulting secondary support plates 23 and 33 may be firmly abutted against a wall or other structure with the panel adjacent the wall and the flanges extending outwardly away from the wall. Where the flanges extend from both sides of the panel 29, the resulting secondary support end plate may be used to support multiple, adjacent shelf units.

As shown in FIG. 11, the end plates 20' and 30', respectively, are configured so that they inter-fit within the recesses defined by the flanges 27 and 37 and adjacent the respective panels 29 and 39. For example, when the end plate 30' is nested with the supporting end plate 33, the end plate 30' rests on and/or is supported by the flange 37. Any loads placed on the tubes 50, 52 or members 60, 62 are transferred to the end plates 20' and 30', and then to the supporting end plates 23 and 33. Although shown with the end plates 20 and 30 fitting within the flanges 27 and 37 of the secondary supporting plates 23 and 33, in an alternative construction the end plates 25 and 30' may overfit the flange or any other structure on the secondary supporting end plates 23 and 33. Virtually any corresponding structure may be used in conjunction with the end plates and supporting end plates, provided the structure enables those components to engage one another and support the shelf 10.

As described above, a novel and useful expandable shelf is provided to permit adaptation and installation without the need to cut the shelf to length or to build special supporting structure.

While the present invention is described with respect to specific embodiments thereof, it is recognized that various modifications and variations may be made without departing from the scope and spirit of the invention, which is more clearly and precisely defined by reference to the claims appended hereto.

The embodiments of the invention in which an exclusive property or privilege is claimed are defined as follows:

1. An expandable shelf, comprising:

a plurality of tubes, each having a first end and a second end, each of said plurality of tubes oriented substantially co-planar with one another;

a plurality of inner members, each having a first end and a second end, each first end of the plurality of inner members being assembled slidingly into a respective first end of each of the plurality of tubes;

a first end plate having a first side and a second side opposite the first side, the first side engaging the second end of each of the plurality of tubes;

a second end plate having a first side and a second side opposite the first side, the first side engaging the second end of each of the plurality of inner members; and a first supporting end plate adapted to be secured to a support structure, said first supporting end plate including a first flange, wherein at least one of said second side of said first end plate and said second side of said second end plate engages and nests within a portion of said first supporting end plate, wherein said first flange supports the at least one of the first end plate and the second end plate, whereby a load on at least one of said plurality of tubes and said plurality of inner members is transferred to said first supporting end plate.

2. The expandable shelf of claim 1, wherein the inner members are at least one of tubes of a dimension to fit slidingly into the plurality of tubes and solid bars.

3. The expandable shelf of claim 1, comprising a second supporting end plate securable to another support structure, said second supporting end plate including a second flange, wherein at least one of said first end plate and second end plate engages said second supporting end plate, wherein said second flange supports the at least one of the first end plate and the second end plate, whereby a load on at least one of said plurality of tubes and said plurality of inner members is transferred to said second supporting end plate.

4. The expandable shelf of claim 1, wherein said first end supporting plate includes a panel having opposing first and second sides, wherein said first flange projects outwardly away from said panel on said first and second sides of the panel.

5. The expandable shelf of claim 1, wherein the tubed and inner members are securely affixed to the respective first and second end plates.

6. The expandable shelf of claim 1, wherein at least one of the first and second end plates define a plurality of recesses said plurality of tubes and inner members press fit into said plurality of recesses.

7. The expandable shelf of claim 1, comprising a support bracket, said support bracket defining a plurality of bracket recesses adapted to receive and support at least one of said tubes and inner members in a region of said at least one of said tubes and inner members between said first end plate and said second end plate.

8. The expandable shelf of claim 7, wherein the support bracket is positionable along the plurality of tubes.

9. An expandable shelf, comprising:

a plurality of tubes, each having a first end and a second end, each of said plurality of tubes oriented substantially co-planar with one another;

a plurality of inner members, each having a first end and a second end, each first end of the plurality of inner members being assembled slidingly into a respective first end of each of the plurality of tubes;

a first end plate having a first side and a second side opposite the first side, the first side engaging the second end of each of the plurality of tubes, the first end plate defining a fastener hole;

a second end plate having a first side and a second side opposite the first side, the first side engaging the second end of each of the plurality of inner members; and a first supporting end plate adapted to be secured to a support structure, said first supporting end plate defining a support hole, wherein at least one of said second side of said first end plate and said second side of said second end plate engages said first supporting end plate so that a load on at least one of said plurality of tubes and said plurality of inner members is transferred to said first supporting end plate, wherein the fastener hole is aligned with the support hole.

10. The expandable shelf of claim 9, wherein said first supporting end plate includes a flange to support a third end plate of another expandable shelf.

11. The expandable shelf of claim 9, wherein said first supporting end plate includes a flange extending generally toward at least one of said first end plate and said second end plate, at least one of said first end plate and said second end plate resting on said flange.

* * * * *